United States Patent [19]

Blakesley

[11] 4,080,704

[45] Mar. 28, 1978

[54] CIRCULAR FORM PROCESS FOR PULLEYS

[75] Inventor: Roland F. Blakesley, Novelty, Ohio

[73] Assignee: Blakesley Pulley Corporation, Cleveland, Ohio

[21] Appl. No.: 762,488

[22] Filed: Jan. 26, 1977

[51] Int. Cl.[2] ..... B21K 1/42

[52] U.S. Cl. ..... 29/159 R; 72/105; 74/230.8; 113/116 D; 228/144; 228/158; 228/165; 228/174

[58] Field of Search ..... 29/159 R, 417, 159.1; 72/105, 106, 180, 181, 177; 113/116 D; 228/144, 152, 158, 165, 166, 169, 173, 174; 74/230.5, 230.8

[56] References Cited

U.S. PATENT DOCUMENTS

| | | | |
|---|---|---|---|
| 2,730,795 | 1/1956 | Bloss | 29/159 R |
| 2,955,748 | 10/1960 | Killian | 29/159 R X |
| 3,694,898 | 10/1972 | Sato | 228/144 |
| 3,838,485 | 10/1974 | Oldford | 29/159 R |

*Primary Examiner*—Victor A. DiPalma
*Attorney, Agent, or Firm*—Frease & Bishop

[57] ABSTRACT

A method of making a multi-V-grooved sheet metal pulley from a flat sheet metal strip. The strip is passed through forming rolls which preform a plurality of generally V-shaped, transversely spaced, longitudinally extending grooves in a portion of the strip, and a generally flat hub wall flange in a transversely adjacent second portion of the strip. The hub wall flange portion of the strip then is notched to preshape the flange prior to circular forming the bottom hub wall of a pulley therefrom. The preformed grooved and notched strip then is severed into individual strips, each of which provides the material for a cup-shaped sheet metal pulley. Each strip then is passed between a pair of wrapping rolls which form the strip into a circular, preferably cylindrical configuration with the strip ends located adjacent to each other. The adjacent ends of the strip then are abutted and welded together, forming a cup-shaped pulley. The grooved portion of the strip forms a generally cylindrically-shaped pulley cup side wall and the hub wall flange portion of the strip forms a circular hub bottom wall at one end of the cylindrical side wall, with the preformed strip grooves forming the pulley V-grooves. The outer V-grooved surface of the pulley cup side wall then is final sized and preferably polished by a rotating finishing roll which also removes any irregularities caused by the welding operation.

14 Claims, 7 Drawing Figures

CIRCULAR FORM PROCESS FOR PULLEYS

BACKGROUND OF THE INVENTION

1. Field of the Invention

The invention relates to a method of forming multi-V-grooved sheet metal pulleys from a flat sheet metal strip. More particularly, the invention relates to a method of circular forming sheet metal pulleys by passing a flat sheet metal strip through a series of roll forms which produce the desired pulley configuration having a bottom wall hub integral with a multi-V-grooved side wall.

2. Description of the Prior Art

Many procedures have been used and are known for the formation of V-groove sheet metal pulleys from flat sheet metal. Many of these procedures involve stamping and drawing operations of sheet metal discs to produce cup-shaped blanks from which V-groove pulleys are subsequently roller spun. The finished V-groove pulleys or the cup-shaped stage blanks for subsequent spinning into V-groove pulleys which are produced by such prior stamping and drawing methods are not in balance dynamically since the pulleys and blanks are formed by series of progressive die steps on a non-rotating blank. Likewise, such stamped and drawn blanks and pulleys require a thicker starting disc or strip due to the uneven thinning of the metal in critical areas of the formed V-grooves.

Many of these problems have been eliminated by directly spinning the cup-shaped blanks and V-groove pulleys from flat sheet metal discs or cup-shaped stage blanks as shown in U.S. Pat. Nos. 1,680,061, 1,728,002, 2,869,223 and 3,852,863. Pulleys formed by these known spinning methods also require thicker starting blanks than desirable as in the stamping and drawing methods, due to the tension stretching and thinning in the metal of the groove walls during the spin forming of the V-grooves.

These known spinning and stamping methods for making V-groove pulleys also do not permit the satisfactory economical manufacture of a pulley with more than three grooves when formed from a single sheet metal blank. U.S. Pat. No. 3,852,863 only provides a method for the spinning of three grooves in a cylindrical cup-side wall of a pulley blank and may involve problems when used for the spinning of four or more grooves in a single blank.

Multiple groove pulleys having more than three grooves have been proposed or used wherein the grooves have been formed singularly or in pairs in separate sheet metal blanks and the separate grooved members then have been assembled to provide the final grooved pulley product having multiple grooves, such as shown for example in U.S. Pat. Nos. 1,700,416, 1,995,907, 2,008,300 and 2,092,571. Such procedures require additional assembling steps increasing considerably the production cost of the multi-V-groove pulleys.

Existing spinning procedures also do not enable a multi-V-groove pulley to be formed satisfactorily in which one or more of the V-grooves are offset in a radial direction with respect to others or when the V-grooves have different cross-sectional configurations on the same pulley.

Pulleys also have been formed by circular forming methods wherein a flat metal strip is passed through a series of forming rolls to form an annular grooved member. Examples of such procedures are shown in U.S. Pat. Nos. 1,641,440, 2,730,795 and 3,838,485. All of these known circular forming methods only form a single or double V-groove rim and require a separate hub flange wall to be attached thereto, which forms a two-piece sheet metal pulley. To form a multi-V-groove pulley having four or more V-grooves by these known methods it would require assembling the separately formed components together in an axial cylindrical arrangement. Likewise, a separate pulley hub bottom wall have to be attached thereto, as shown in U.S. Pat. No. 3,838,485. Again, such additional assembling of a plurality of separate components increases considerably the cost of producing such pulleys on a mass production basis.

Problems also are encountered in the circular forming of multi-groove annular members where the individual members are formed from convolutions of a continuous helix, such as shown in Pat. Nos. 1,753,586, 2,492,967, 3,001,496, 3,172,787, 3,797,088 and 3,838,485. The widths of the grooved strip required for the formation of a plurality of V-grooves is such that the distance that the ends of the severed convolution must be moved for alignment prior to joining is substantial, thereby placing an undesirable twisting tension on certain portions of the grooved annular rim.

There, thus, has been an existing need for a procedure for the circular forming of sheet metal pulleys having the hub flange bottom wall formed integrally with the cylindrical or annular V-grooved side wall, eliminating the additional procedures heretofore required of attaching a hub flange bottom wall to a circularly formed V-groove rim. Likewise, there has been a need for an economical procedure for the circular forming of multi-grooved pulleys having at least four V-grooves formed adjacent one another in a single sheet metal blank to eliminate the assembling of multiple components heretofore required.

SUMMARY OF THE INVENTION

Objectives of the invention include providing a new method and procedure for the manufacture from a sheet metal strip of a V-groove pulley having a hub flange wall formed integral with the V-groove pulley side wall by a circular forming process; providing a procedure for the manufacture of a sheet metal pulley having at least four or more V-shaped grooves formed in the cylindrical side wall of a cup-shaped configuration with a bottom hub flange wall connected integrally therewith, eliminating the joining of abutting V-groove sections and the separate attachment of a hub flange bottom wall thereto as required by prior methods; providing such a circular forming process which enables a uniform material thickness to be maintained throughout the V-grooves greatly reducing and eliminating undesirable thinning of the metal as in known stamping, drawing and spinning operations; providing a circular pulley forming process in which the pulleys formed thereby have an improved surface finish with a uniform contour or shape, in which the number and groove arrangement in the pulley side wall is not limited as in prior art methods, in which the roundness and concentricity of the pulley is improved, and in which weight reduction is economically feasible due to the elimination of undesirable thinning of the metal; and providing a circular pulley forming process for producing multi-V-grooved sheet metal pulleys which eliminate difficulties heretofore encountered, achieves the various objectives indicated in a practical, workable and easily controlled manner, and solves problems and satisfies needs which have existed in the art of manufacturing V-groove pulleys.

These objectives and advantages are obtained by the improved method of making a multi-V-grooved sheet metal pulley of the type having a bottom hub wall and an integrally connected outer generally cylindrical side wall having a plurality of V-grooves formed therein, from a flat sheet metal strip, including the steps of feeding a strip of flat sheet metal to a work station; forming a plurality of generally V-shaped longitudinally extending, transversely spaced grooves in a first portion of the sheet metal strip and a hub wall flange in a second portion of the strip; preforming the strip into a curved configuration and notching the hub wall flange of the strip to form a plurality of hub wall flange segments; rolling the preformed strip into an annular cup-shaped pulley blank configuration with the strip ends being placed adjacent each other, and with the grooved portion of the strip forming an annular cup side wall and the hub wall flange segments forming a generally circular hub bottom wall at one end of the annular side wall and transverse to the axis of the annular side wall; joining together the adjacent ends of the strip; and then finish rolling the joined cup-shaped pulley blank to remove any irregularities in the multi-V-grooved side wall.

BRIEF DESCRIPTION OF THE DRAWINGS

The preferred method steps of the invention - illustrative of the best mode in which applicant has contemplated applying the principles - is set forth in the following description and shown in the drawings, and is particularly and distinctly pointed out and set forth in the appended claims.

Similar numerals refer to similar parts throughout the drawings.

DESCRIPTION OF THE PREFERRED EMBODIMENT

Figures 1, 2, 7:
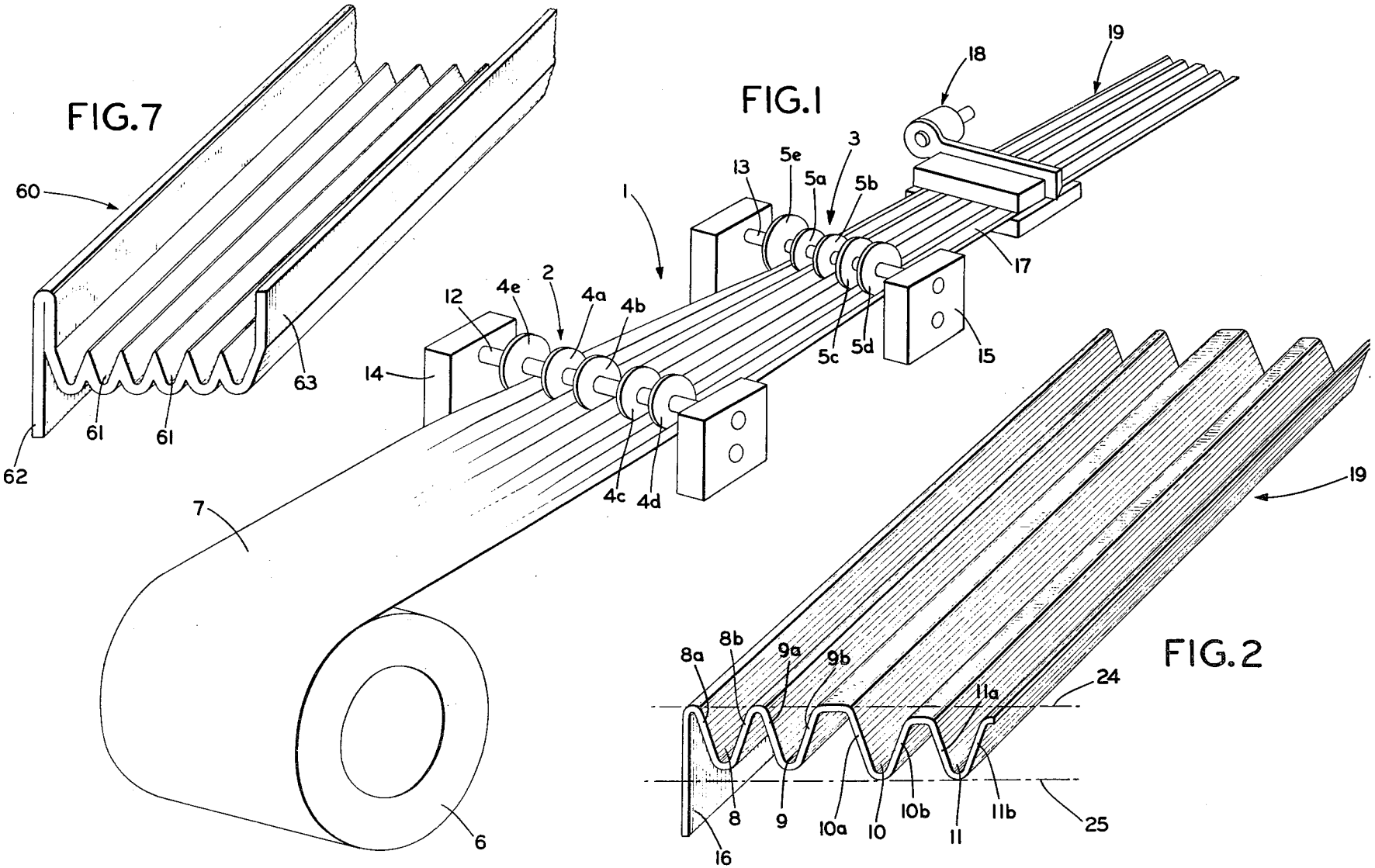
FIG. 1 is a diagrammatic perspective view showing the roll forming of the preformed V-grooves and hub wall flange in a continuous sheet metal strip.
FIG. 2 is an obtuse perspective view of a single strip of the roll formed sheet metal strip of FIG. 1, sheared from the continuously formed strip.
FIG. 7 is an obtuse perspective view, similar to FIG. 2, of a modified roll preformed strip.

A portion of a type of roll forming apparatus for carrying out certain of the steps of the improved circular form process is shown diagrammatically in FIG. 1, and is indicated generally at 1. Roll former 1 includes a plurality of spaced roll stations 2 and 3, each station containing a plurality of rotatably mounted rollers 4 and 5, respectively.

A coil 6 of continuous sheet metal strip 7 is mounted adjacent roller station 2 for feeding the strip material into roll former 1. Strip 7 is fed through roller stations 2 and 3 by suitable power-driven feed means (not shown) with rollers 4*a–d* and 5*a–d* preforming generally V-shaped grooves 8, 9, 10 and 11, respectively (FIG. 2) therein. Rollers 4 and 5 are mounted on shafts 12 and 13, respectively, which preferably are rotatably mounted in bearing housings 14 and 15. Rollers 4*a–d* begin the initial preformation of grooves 8–11 with the complete preformation being completed by rollers 5*a–d*. Endmost rollers 4*e* and 5*e* form a hub wall flange 16 along an outer edge portion of strip 7.

Thus, the initial step of the improved circular form process is the feeding of a strip of sheet metal 7, preferably from a continuous roll 6, through a roll forming station (2 and 3), which preforms a plurality of generally V-shaped longitudinally extending, transversely spaced grooves 8–11 in a portion of the strip, simultaneously with the forming of a hub flange wall 6 along an opposite edge portion of strip 7. Grooves 8–11 are formed adjacent each other and are spaced transversely across the majority portion of strip 7. Grooves 8–11 are formed by pairs of V-shaped walls 8*a–8b*, 9*a–9b*, 10*a–10b*, and 11*a–11b*, respectively. Hub flange 16 extends longitudinally along an edge of strip 7 and preferably extends generally parallel with the center lines of grooves 8–11 when viewed in cross section as shown in FIG. 2.

The rollers 4 and 5 shown diagrammatically at stations 2 and 3 are upper rollers which are backed up by complementary lower rollers to impart the desired shape to the grooves 8–11.

The preformed, rolled continuous strip 17, upon advancing beyond rolling station 3, is severed by a cutting mechanism 18 into individual strips 19 (FIG. 2) for subsequent circular formation into a multi-V-grooved pulley. The shearing or cutting mechanism 18 is shown diagrammatically in FIG. 1 and may be of any usual construction and forms no particular part of the invention. The length of severed strip 19 is determined by the diameter of the final pulley to be produced by the improved circular form process.

The cross-sectional configuration of strip 19, as shown in FIG. 2, illustrates the formation of the four V-grooves 8–11, with grooves 8 and 9 being offset with respect to grooves 10 and 11, as shown by dot-dash lines 24 and 25. This particular cross-sectional configuration of the preformed V-grooves is illustrative of one type of configuration which may be formed by roll stations 2 and 3. Thus, this configuration shows that the improved circular form process enables a pulley to be formed having more than three grooves, as well as a pulley being formed in which the grooves are offset with respect to each other.

Figure 3:
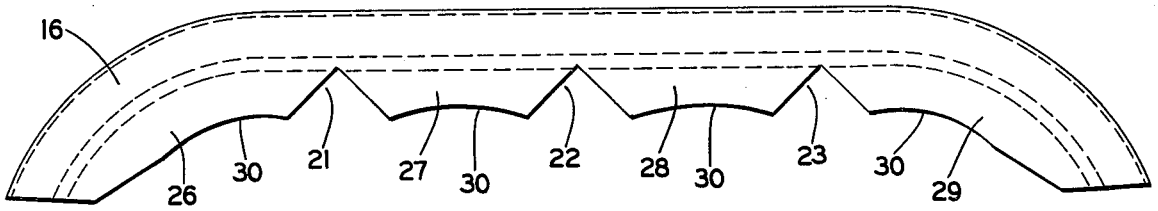
FIG. 3 is an elevational view of the left hand side of the strip of FIG. 2, after being preformed and notched.

FIG. 3 illustrates an additional operation which may be necessary in forming certain pulley configurations. A plurality of V-shaped notches 21, 22 and 23 are made in hub flange wall 16, forming a plurality such as four projecting hub wall flange segments 26, 27, 28 and 29 thereon. The segment ends are formed with curved contours 30. Strip 19 also may be preformed in which the strip ends are curved inwardly toward each other in a start of a circular configuration. These preforming and notching operations of FIG. 3 may be preformed on the continuous grooved strip 7 or 17 prior to separation of individual strips 19 therefrom, or else may be performed on the individual severed strips 19 in a separate operation. Usual preforming or bending and notching apparatus may be used for carrying out these steps of the invention and therefore are not shown in the drawings.

Figure 4:
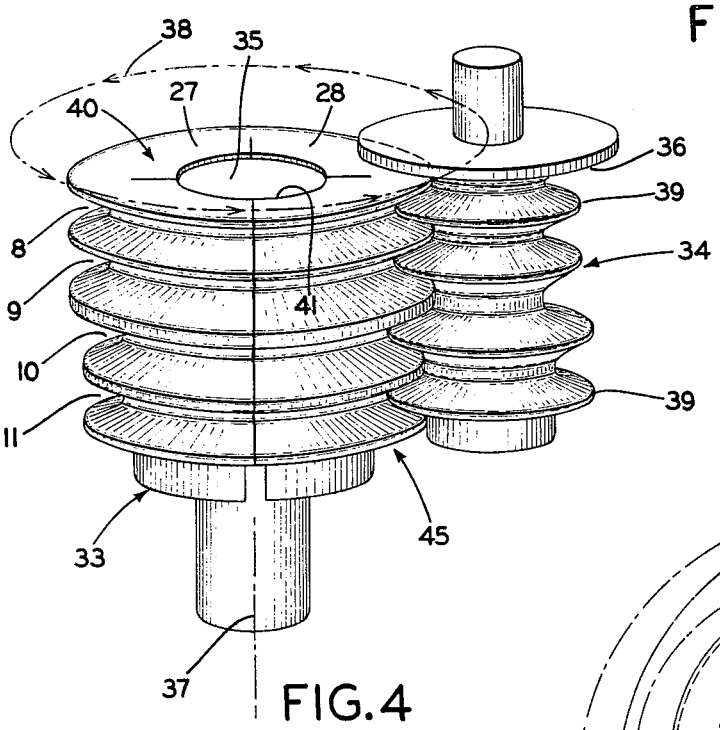
FIG. 4 is a diagrammatic perspective view showing the roll forming of the sheared strip of FIG. 2 into an annular configuration with the strip ends being placed in abutment.

The next step of the improved circular form process is shown diagrammatically in FIG. 4. A strip 19 is fed between a pair of circular forming or wrapping rolls 33 and 34. Rolls 33 and 34 have external grooved configurations complementary to grooves 8–11 of strip 19. Roll 33 preferably is of the expandable mandrel type which expands outwardly to the desired pulley diameter and then is collapsed after wrapping of the pulley blank strip therein, permitting easy removal of the annular, cup-shaped, split pulley blank 45. Roll 33 preferably is rotatable about a fixed axis 37 and has a smooth flat top surface 35. Roll 34 is rotatable concentrically about roll 33 and axis 37, as shown by directional arrows 38. Roll 34 has a radially extending upper flanged surface 36 of larger diameter than its grooved lower surface.

Strip 19, upon being fed between rolls 33 and 34, is wrapped about roll 33 by the rotation or roll 34 with the strip ends being aligned adjacent to each other. Strip grooves 8–11 are aligned with and further reformed within the complementary grooves of internal roll 33 by the action of annular projections 39 of roll 34, which projections are complementary in size and configuration with the grooves of roll 33 and strip grooves 8–11.

There is no appreciable metal thinning or stretching by rolls 4–5 and roll 34 during the cold forming of strips 7 and 19, as shown in FIGS. 1 and 4. The metal of strip 7 is merely reformed by rolls 4–5 into the grooved configuration of strip 19, with the V-groove walls being reformed only a small amount when worked by roller 34 upon forming the annular cup-shaped split pulley blank of FIG. 4, indicated at 45. Thus, there is no undesirable thinning or weakening of the V-groove walls during its working, as in prior stamping, drawing and spinning operations.

The roll forming step of FIG. 4 imparts a set to the metal of strip 19 so that the abutted ends of the rolled strip do not separate appreciably upon removal of rolls 33 and 34. Upper flanged surface 36 of roll 34 maintains hub wall flange segments 26–29 against top surface 35 of roll 33. The adjacent edges of segments 26–29 are abutted upon the wrapping of strip 19 about roll 33, as shown in FIG. 4, forming an annular hub bottom wall 40 with the curved contoured ends 30 of segments 26–29 forming a circular hub bottom wall central opening 41. Opening 41 is adapted to receive a pulley mounting hub therein in a usual manner as in a stamped or spun pulley in which the central bottom wall opening is formed by a stamping or shearing procedure; and alternately the wall 40 may be pierced for bolting to a member to which the pulley is connected.

Figure 5:
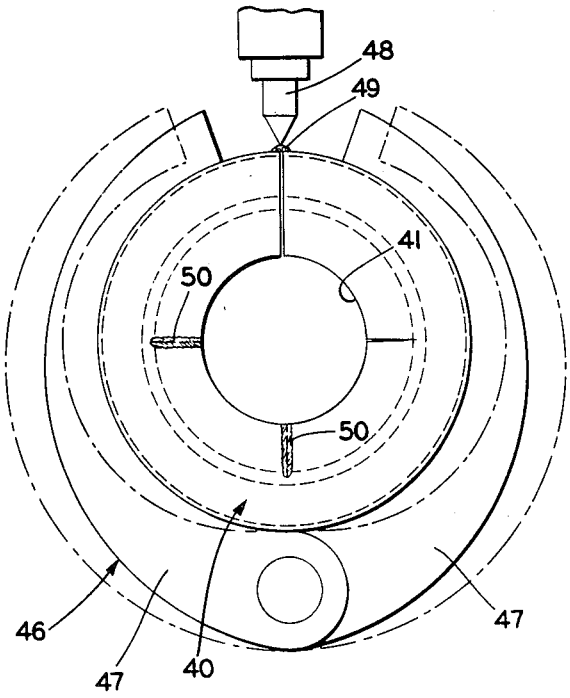
FIG. 5 is a diagrammatic top plan view showing the welding of the abutted ends of the annular formed strip of FIG. 4.

The cylindrical cup-shaped split pulley blank 45 formed by the wrapping step of FIG. 4 then is removed from roll 33 and is mounted within a clamping of retaining mechanism indicated generally at 46 (FIG. 5). Clamping mechanism 46 is shown diagrammatically as having a pair of pivotally mounted C-shaped levers or jaws 47 which nearly encircle the outer periphery of pulley blank 45 when in closed position (full lines, FIG. 5), to insure abutment of the aligned strip ends.

The abutted strip ends then are joined, preferably by a movable welding electrode or tip 48 forming a weld 49 along the abutted ends. The abutted ends may be joined by other means such as brazing, soldering, etc., if desired, without departing from the concept of the invention. The abutted edges of the hub wall flange segments 26–29, likewise, may be joined by welds 50 if desired.

Figure 6:
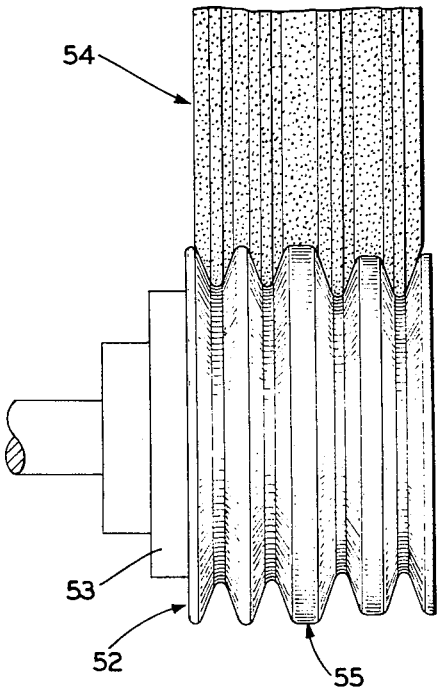
FIG. 6 is a diagrammatic view showing the roll finishing of the V-grooved side wall of the joined pulley of FIG. 5.

The joined pulley, indicated at 52, then is removed from clamping mechanism 46 and placed on a rotating mandrel 53 and final sized, ground and polished by a suitable finishing roll 54 or a plurality of individual rolls. Roll 54 smooths out any minor irregularities or gauge variations which may have occurred in the V-grooved cylindrical wall 55 of pulley 52 during the series of roll forming operations of FIGS. 1–4. Roll 54 further polishes and finishes the surfaces of the V-groove forming walls and removes burrs and rough areas caused by weld 49. Although finishing roll 54 is shown and illustrated in FIG. 6 as a single multi-grooved roll, it may consist of a plurality of separate rolls which are mounted about the rotating pulley 52 and successively perform operations thereon, such as grinding to remove weld imperfections, then ironing to insure roundness and concentricity, and then perform a finish polishing operation.

FIG. 7 shows a modified strip 60 which may be formed by a plurality of rolls in a similar manner as is strip 19 by a modified groove forming apparatus of FIG. 1. The modified forming apparatus preferably will have six intermediate rolls which will form the six V-grooves 61. Two outer rolls will form the hub wall flange 62 and a belt retaining flange 63 along opposite edges of the grooved strip. Strip 60 then may be preformed, with hub flange wall 62 being notched in a similar manner as wall 16 of strip 19 prior to being roll formed into a cylindrical split-pulley configuration by the rolls of FIG. 4.

FIG. 7 illustrates how a multi-V-grooved pulley can be formed easily merely be preforming a flat strip of sheet metal with any desired number and configuration of V-grooves therein merely by changing the number and configuration of the strip preforming rolls of apparatus 1.

Accordingly, the present invention provides substantial improvements in the art of making circular formed multi-V-grooved pulleys of the type having a hub bottom wall and an integrally joined axially extending, preferably cylindrical, side wall; provides for the manufacture of such a statically and dynamically balanced sheet metal multi-V-grooved pulley from a metal strip having a reduced thickness than heretofore required for a similar pulley formed by stamping or roller spinning due to the elimination of metal thinning and stretching in critical areas of the V-grooves; provides a method of forming a pulley in which the pulley side wall may be formed with a variety of different shapes, sizes and configurations of V-grooves in the same side wall merely by providing various preforming rolls between which the sheet metal starting strip is passed, and in which the hub flange bottom wall is connected integrally with the cylindrical side wall providing a one-piece sheet metal pulley, eliminating separate welding and attachment procedures; and provides a method which satisfies the various objectives set forth, which solves problems and satisfies demands existing in the art, and which obtains the new results indicated.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the new circular form process for pulleys is carried out, the details of the steps of the improved method, and the advantageous, new and useful results obtained; the new and useful structures, devices, elements, arrangements, parts, and combinations are set forth in the appended claims.

I claim:

1. In a method of making a generally cup-shaped multi-V-grooved sheet metal pulley of the type having a bottom flange wall and an integrally connected outer generally cylindrical side wall having a plurality of V-grooves formed therein, from a flat sheet metal strip, including the steps of:

(a) feeding a strip of flat sheet metal from a strip supply;

(b) forming in the moving feed strip a plurality of generally V-shaped longitudinally extending, transversely spaced grooves in a first portion of the strip, and a bottom wall forming flange in a second portion of said strip located laterally of the first portion;

(c) rolling the formed strip into an annular cup-shaped split pulley blank with the strip ends located adjacent each other to reform the grooved portion of the strip into an annular cup side wall and to reform the bottom wall forming flange into a cup bottom wall extending transversely of the axis of the side wall at one end of the annular side wall;

(d) joining together the adjacent ends of the reformed cup-shaped split pulley blank; and (e) then finish rolling the joined cup-shaped pulley blank to remove irregularities in the V-grooved pulley side wall.

2. The method defined in claim 1 including the step of notching the bottom wall forming flange of the strip prior to rolling the strip into an annular cup side wall to form a plurality of bottom wall forming flange segments.

3. The method defined in claim 2 in which the rolling of the strip into an annular cup-shaped split pulley blank locates the bottom wall forming flange segments in abutting relationship to form the cup bottom wall.

4. The method defined in claim 2 including the step of preforming the notched strip into a curved configuration in preparation for rolling the strip into the cup-shaped split pulley blank.

5. The method defined in claim 1 in which the strip supply is a coiled continuous sheet metal strip; and in which the moving feed strip is a continuous sheet metal strip.

6. The method defined in claim 5 including the step of severing a predetermined length strip from the continuous sheet metal strip after the grooves and bottom wall forming flange have been formed in the feed strip.

7. The method defined in claim 1 in which the adjacent ends of the reformed cup-shaped split pulley blank are joined together by welding.

8. The method defined in claim 7 in which the finish rolling of the walls of the V-grooves of the joined cup-shaped pulley blank pressure works the metal groove walls to remove irregularities therein.

9. The method defined in claim 1 including clamping the split pulley blank to hold adjacent strip ends in abutting relationship while being joined together.

10. The method defined in claim 1 in which at least four V-grooves are formed in the first portion of the strip.

11. In a method of making a generally cup-shaped V-grooved sheet metal pulley of the type having a bottom hub flange wall and an integrally connected outer generally cylindrical side wall having at least a single V-groove formed therein, from a flat sheet metal strip, including the steps of:

(a) feeding a strip of flat sheet metal from a strip supply;

(b) forming in the moving feed strip at least a single generally V-shaped longitudinally extending groove in a first portion of the strip, and a bottom hub wall forming flange in a second portion of said strip located laterally of the first portion;

(c) notching the hub wall forming flange to provide a plurality of hub wall forming flange segment while feeding the strip;

(d) rolling the formed and notched strip into an annular cup-shaped split pulley blank with the strip ends located adjacent each other to reform the grooved portion of the strip into an annular cup side wall and to reform the hub wall forming flange segments into a cup bottom hub flange wall extending transversely of the axis of the side wall at one end of the annular side wall with adjacent segments in abutment, whereby the abutted segments form a central opening in said hub flange wall;

(e) joining together the adjacent ends of the reformed cup-shaped split pulley blank; and (f) then finish rolling the joined cup-shaped pulley blank to remove irregularities in the V-grooved pulley side wall.

12. The method defined in claim 11 including the step of preforming the notched strip into a curved configuration in preparation for rolling the strip into the cup-shaped split pulley blank.

13. The method defined in claim 11 in which a plurality of generally V-shaped longitudinally extending, transversely spaced grooves are formed in the first portion of the strip.

14. The method defined in claim 11 in which at least four V-grooves are formed in the first portion of the strip.

* * * * *